US007252093B2

(12) United States Patent
Rodriguez

(10) Patent No.: US 7,252,093 B2
(45) Date of Patent: Aug. 7, 2007

(54) HAIR EXTENSION METHODS AND RELATED DEVICES

(75) Inventor: Paula Rodriguez, PMBG, 267, 27881 La Paz Rd., Suite O, Laguna Niguel, CA (US) 92677-3933

(73) Assignees: Mario Rodriguez, Newport Beach, CA (US); Paula Rodriguez, Newport Beach, CA (US)

( * ) Notice: Subject to any disclaimer, the term of this patent is extended or adjusted under 35 U.S.C. 154(b) by 0 days.

(21) Appl. No.: 11/078,919

(22) Filed: Mar. 11, 2005

(65) Prior Publication Data

US 2006/0060212 A1 Mar. 23, 2006

Related U.S. Application Data

(60) Provisional application No. 60/611,916, filed on Sep. 21, 2004.

(51) Int. Cl.
*A41G 3/00* (2006.01)

(52) U.S. Cl. ..... 132/201

(58) Field of Classification Search ..... 132/201
See application file for complete search history.

(56) References Cited

U.S. PATENT DOCUMENTS

| | | | | | |
|---|---|---|---|---|---|
| 4,372,330 | A | * | 2/1983 | Nelson | 132/53 |
| 4,771,798 | A | * | 9/1988 | Candino | 132/53 |
| 5,107,867 | A | | 4/1992 | Barrington | |
| 5,121,761 | A | | 6/1992 | Meister | |
| 5,357,986 | A | * | 10/1994 | Hargrett | 132/201 |
| 5,413,124 | A | | 5/1995 | Incando | |
| 5,634,478 | A | * | 6/1997 | Shakir | 132/201 |
| 5,752,530 | A | * | 5/1998 | Traintinger | 132/201 |
| 5,792,169 | A | | 8/1998 | Markman | |
| 5,813,418 | A | | 9/1998 | Pillars | |
| 5,899,209 | A | | 5/1999 | McDonald et al. | |
| 6,109,274 | A | * | 8/2000 | Ingersoll | 132/201 |
| 6,135,122 | A | | 10/2000 | Campbell et al. | |
| 6,405,736 | B2 | | 6/2002 | Townsend | |
| 2001/0035192 | A1 | | 11/2001 | Townsend | |
| 2005/0161057 | A1 | * | 7/2005 | Takemura | 132/201 |

FOREIGN PATENT DOCUMENTS

| | | | |
|---|---|---|---|
| EP | 1-166-664 | A1 | 1/2002 |
| EP | 1-312-315 | A1 | 5/2003 |
| GB | 2-327-605 | A | 3/1999 |
| GB | 2-378-132 | A | 5/2003 |
| WO | WO-97/18758 | A | 5/1997 |
| WO | WO-98/47434 | A | 10/1998 |
| WO | WO-03/013296 | A2 | 2/2003 |
| WO | WO-03/013296 | A3 | 2/2003 |

* cited by examiner

*Primary Examiner*—Todd E. Manahan
(74) *Attorney, Agent, or Firm*—Rolando Tong

(57) ABSTRACT

The present invention includes various hair extension methods and related devices. One hair extension method comprises the following steps: determining a location around a scalp for attaching at least one extension hair; gathering a first group of original hair, the first group of original hair being proximate to the portion of the scalp determined to be the location for attaching the extension hair; inserting a portion of the first group of original hair in a first band; providing a first group of artificial support material; inserting a portion of the first group of the artificial support material in the first band, the combination of the first group of original hair and the first group of artificial support material forming a first hair combination; gathering a second group of original hair, the second group of original hair being substantially proximate to the first hair combination; inserting in a second band the combination of at least one hair from the second group of original hair and a portion of the first hair combination, the hairs in between the first and the second band defining a hair track; and attaching the extension hair to the hair track.

11 Claims, 11 Drawing Sheets

HAIR EXTENSION METHODS AND RELATED DEVICES

CROSS REFERENCE TO RELATED APPLICATIONS

This application claims priority to and incorporates by reference provisional application Ser. No. 60/611,916 filed on Sep. 21, 2004.

FIELD OF INVENTION

The present invention relates to hairdressing techniques and products, particularly hair extension methods and related devices.

BACKGROUND

Many hair salons provide hair extension services. Hair salon customers ask for hair extensions for various reasons, including to lengthen original hair without having to rely on the natural growth of the original hair, to add volume to the original hair, and generally to enhance the overall appearance of the person's hairstyle.

Hair extension techniques exist. For example, U.S. Pat. No. 5,121,761 issued to Meister discloses a hair extension method wherein a person's original hairs are gathered into several groups. Each group is retained and separated from the other groups of original hairs using a bead. A hair weft is sewn to the person's original hair, and the beads serve as anchors for the hair weft.

At least one problem with the technique disclosed in Meister is that the technique subjects the original hairs to substantial stress, as each group of original hairs carries the weight of the hair weft and the bead. The original hairs are being pulled from the scalp by the weights of the bead and the hair weft. Therefore, the original hairs are susceptible to breaking off from the scalp, especially if the original hairs are dry and thin. The person wearing the hair extension may also find it uncomfortable to have original hairs being pulled by the hair extension. A hair extension technique that minimizes the stress on the original hairs is desired.

Another problem is that the attachment of the hair extension with the Meister technique is susceptible to breaking. A hair brush can be caught in between the person's scalp and the beads. If the hair brush is stuck and the person pulls the hair brush downward, the thread that holds the hair weft to the person's scalp can unravel or loosen and eventually break. Additionally, the original hairs can detach from the scalp thereby weakening further the support for the hair weft.

Another hair extension method is disclosed in U.S. Pat. No. 5,899,209, which is issued to McDonald. The hair extension method in '209 appears to require the parting and plaiting of the user's hair. Several plaits are formed, and the plaits are inserted through the custom ring assemblies of individual hair extensions. At least one problem with the technique in '209 is that the security of the attachment of the hair extensions appears to rely on the snug fit of the plaits to the ring assemblies. Frequent hair brushing may loosen the attachment of the hair extensions to their respective plaits.

The hair extension attached using the McDonald technique may also make it difficult for the person to brush his or her hair because of the plaits. A hair extension technique that minimizes bumps, gaps, and crevices within the lengths of the hairs and prevents hair brushes or combs from being trapped is desired to facilitate smooth hair brushing.

Another hair extension method appears to be disclosed in International Publication Number WO 03/013296 A2 of Rebecca Helen Jessup. The Jessup application requires the formation of a plurality of strands around the person's scalp. An elastic band is used to secure each strand. A flexible tie is then looped around the strand between the band the person's scalp. A portion of each strand is woven and platted with artificial strands to extend the length of each strand.

At least one problem with the technique disclosed in the Jessup application, which is also a problem with the technique in '209, is that both techniques may be time consuming. For instance, '209 requires having to form a number of individual plaits. The Jessup application requires having to form a number of strands, having to loop flexible ties on each strand, and having to weave and plait artificial strands with the natural strands. Thus, a hair extension method that provides secure attachment of the hair extension and that can be implemented with minimal time is desired.

BRIEF DESCRIPTION

The present invention includes various hair extension methods and related devices. One hair extension method comprises the following steps: determining a location around a scalp for attaching at least one extension hair; gathering a first group of original hair, the first group of original hair being proximate to the portion of the scalp determined to be the location for attaching the extension hair; inserting a portion of the first group of original hair in a first band; providing a first group of artificial support material; inserting a portion of the first group of the artificial support material in the first band, the combination of the first group of original hair and the first group of artificial support material forming a first hair combination; gathering a second group of original hair, the second group of original hair being substantially proximate to the first hair combination; inserting in a second band the combination of at least one hair from the second group of original hair and a portion of the first hair combination, the hairs in between the first and the second band defining a hair track; and attaching the extension hair to the hair track.

Another hair extension comprises the following steps: determining a location around a scalp for attaching at least one extension hair; gathering a first group of original hair, the first group of original hair being proximate to the portion of the scalp determined to be the location for attaching the extension hair; inserting a portion of the first group of original hair in a first band; gathering a second group of original hair, the second group of original hair being substantially proximate to the first hair combination; inserting in a second band the combination of at least one hair from the second group of original hair and at least one hair from the first group of original hair, the hairs in between the first and the second band defining a hair track; providing a plurality of hair wefts, each hair weft comprising a plurality of hair groups, one end of the plurality of hair groups being arranged in side by side and grouped together to form a grouped hair end, the grouped hair end comprising two opposing sides, each side comprising an adhesive; attaching at least a portion of a first hair weft from the plurality of hair wefts to the hair track; and attaching at least a portion of a second hair weft from the plurality of hair wefts onto the first hair weft, wherein the first hair weft comprises a first hair color and the second hair weft comprises a second hair color.

The above description sets forth, rather broadly, a summary of certain embodiments of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Hair Extension Methods

The present invention comprises various hair extension methods and devices for implementing the same methods. At least one hair extension method preferably includes the following steps. A user preferably determines the location where a hair extension will be attached, hereinafter referred to as "Location A." In the example shown in FIG. 1, the user has decided to attach the hair extension (not shown) substantially in the middle of the back side of the person's head. The user preferably reduces the amount of hair around Location A by separating hairs growing from the top of Location A from hairs growing from Location A downwards. The user preferably uses a hair clip 20 or hair pins (not shown) to hold the hairs at the top of Location A.

Figure 2:
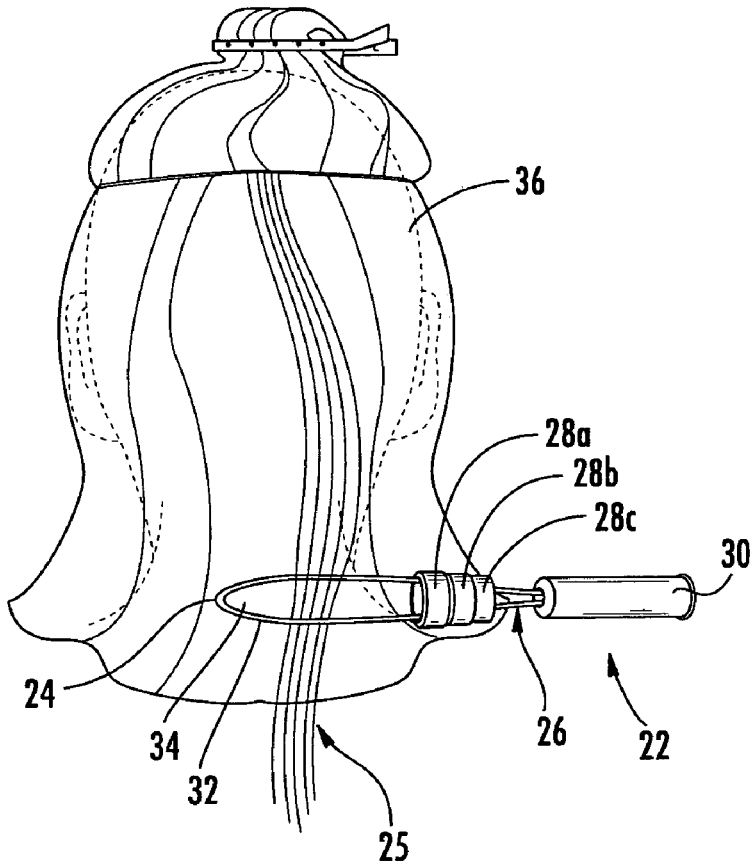
FIG. 2 is substantially a rear view of the person's head as shown in FIG. 1 and further showing a manner of gathering and retaining a first group of original hairs using a hair grouping device.

Referring to FIG. 2, the user preferably selects and gathers a first group of the person's original hairs 25. As used herein, the term "original hair" refers to the hair originating and growing from the person to whom the hair extension will be attached. A hair grouping device 22 may be used to group the selected original hairs 25. The hair grouping device 22 preferably includes a loop of flexible material 32, such as a piece of wire. The loop of flexible material preferably defines a continuously looping end 24 and a handle end 26. The hair grouping device 22 preferably includes a plurality of hollow bands 28*a*, 28*b*, and 28*c* configured to confine and retain the group of hair that will be contained therein. The handle end 26 may be attached to a holder 30. The holder 30 may be a piece of solid material, such as wood, molded plastic, or metal, that is configured to receive and secure the handle end 26 of the loop of flexible material 32. Alternatively, the holder 30 may be eliminated, and the handle end 26 may be twisted to form a holder.

Figure 3:
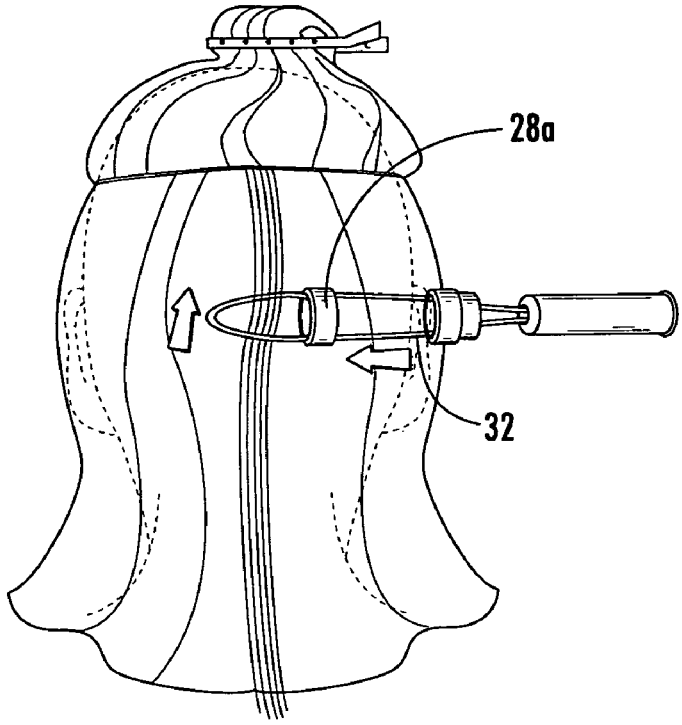
FIG. 3 is substantially a rear view of the person's head as shown in FIGS. 1 and 2 and further showing the steps of moving the hair grouping device towards a person's scalp and sliding a band towards a continuously looping end of the hair grouping device.
Figure 4:
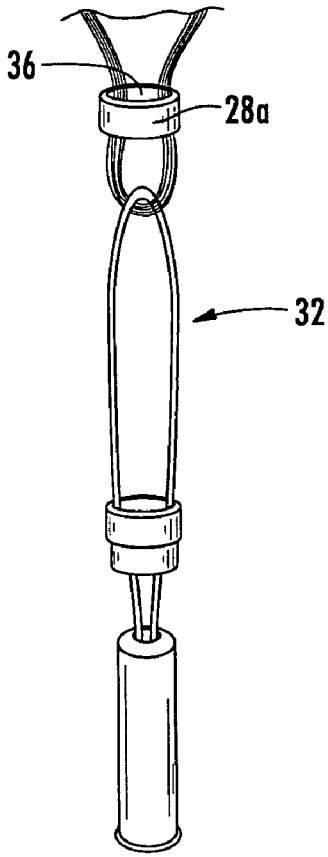
FIG. 4 is substantially a close-up view showing how the hair grouping device pulls and inserts the group of original hairs through a band.

The user may insert the first group of the person's original hairs 25 through the opening 34 created by the loop of flexible material 32. The flexible material 32 may be moved closer towards the person's scalp 36, and the band 28*a* may be moved towards the continuously looping end 24 (FIG. 3). Referring now to FIG. 4, as the band 28*a* reaches past the continuously looping end 24, the band 28*a* preferably disengages from the loop of flexible material 32. The looping end 24 of the flexible material 32 holds onto the group of original hairs 25 and is used to pull the group of original hairs 25 through the hollow interior 36 of the band 28*a* thereby facilitating the insertion of the group of original hairs 25 through the band's hollow interior 36.

Figure 5:
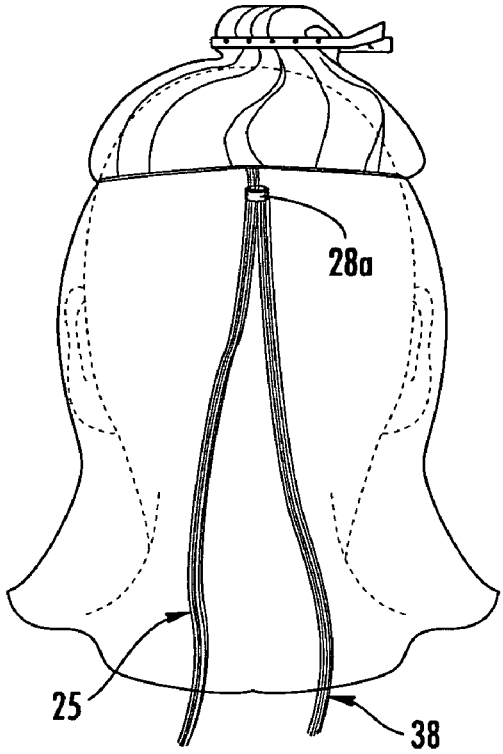
FIG. 5 is substantially a rear view of the person's head as shown in FIGS. 1, 2, and 3 and further showing a group of artificial hairs and a group of original hairs being positioned within the hollow interior of the band.

Referring now to FIG. 5, a group of artificial hairs 38 is preferably inserted through band 28*a*. As used herein, the term "artificial hair" refers to a hair that does not naturally originate from the person to whom the hair extension will be attached. The term "artificial hair" may be a synthetic hair, an animal hair, a hair of a person different from the person to whom the hair extension will be attached, or a transplanted hair of the person to whom the hair extension will be attached.

In another embodiment of the hair extension method, a piece of rope that includes braided strands of fibers is preferably used in lieu of artificial hair. At least one end of the rope is preferably glued to group the strands of fibers and to form a structure that would neatly fit inside the band. The rope may include cotton, nylon, or polyester fibers or various combinations of said materials. The rope may be made of materials used to manufacture a bookmark, and may be obtained from the Paper Company in Lincoln Park, N.J.

Band 28*a* preferably now has the group of original hairs 25 and the group of artificial hairs 28 or the rope inside its hollow interior. Band 28*a* is preferably made of compressible metal or other materials known in the art to provide a substantially tight fit for the group of hairs and the artificial hair or rope configured to be positioned inside its hollow interior. A band crimper, such as a pair of pliers or the alternative band crimper and opener disclosed below, may be provided. Band 28*a* is preferably crimped to secure the original and artificial hairs or rope positioned inside it.

Figure 6:
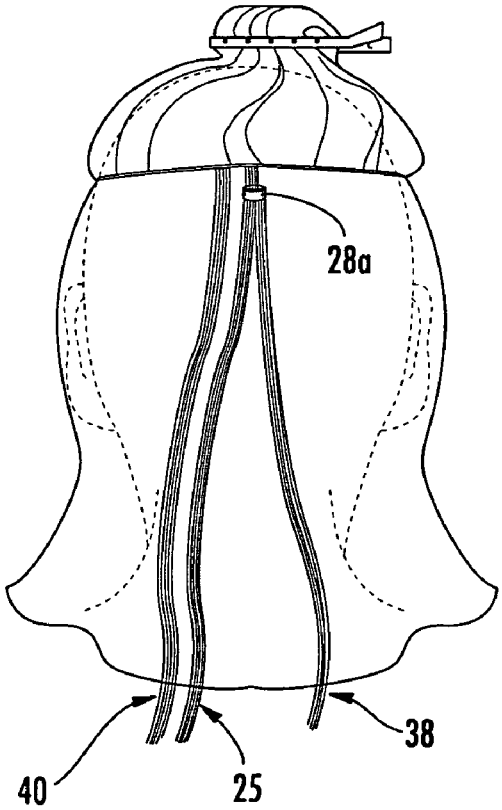
FIG. 6 is substantially a rear view of the person's head as shown in FIG. 5 further showing a step of gathering a mixture of hairs from a second group of original hairs, a first group of original hairs, and a group of artificial hairs.
Figure 7:
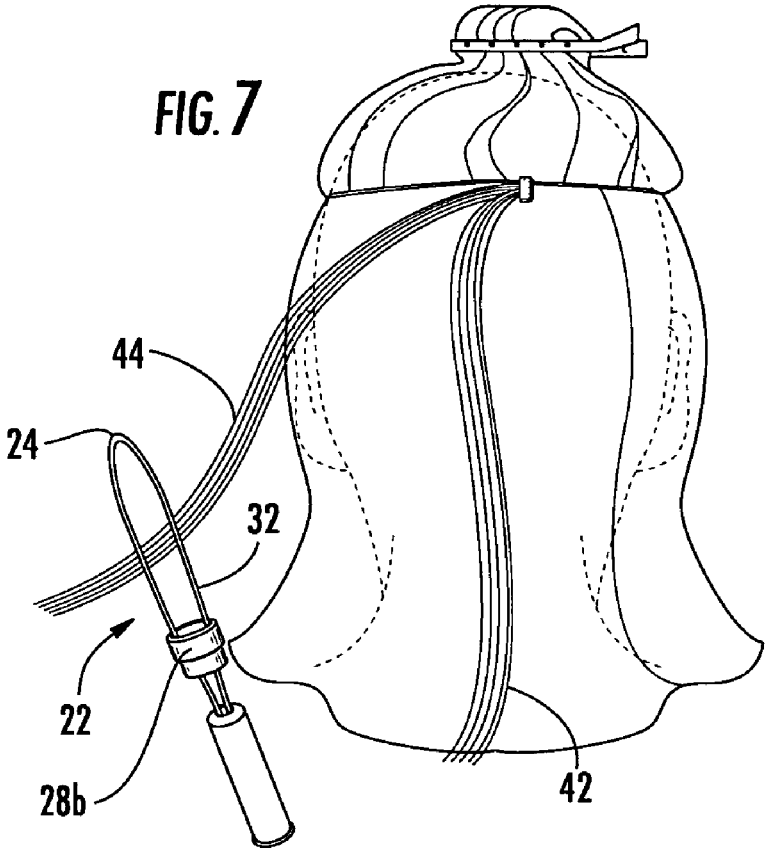
FIG. 7 is substantially a rear view of the person's head as shown in FIG. 6, further showing a step of reducing the amount of the hair mixture from FIG. 6 and grouping the remaining amount of hair mixture using the hair grouping device.

Referring to FIG. 6, a second group of the person's original hairs 40 is preferably selected. The second group of original hairs 40 is preferably mixed with the first group of original hairs 25 and the group of artificial hairs 28 or rope. The mixture is hereinafter referred to as "Hair Mixture A." In FIG. 7, a portion 42 of Hair Mixture A is preferably dropped. A second portion 44 of Hair Mixture A is preferably inserted through the hair grouping device 22. The hair grouping device 22 is preferably moved towards the scalp of the person, and the user preferably slides the band 28*b* toward the continuously looping end 24 of the flexible material 32 until the second portion 44 is inserted through the hollow interior of the band 28*b*.

Figure 8:
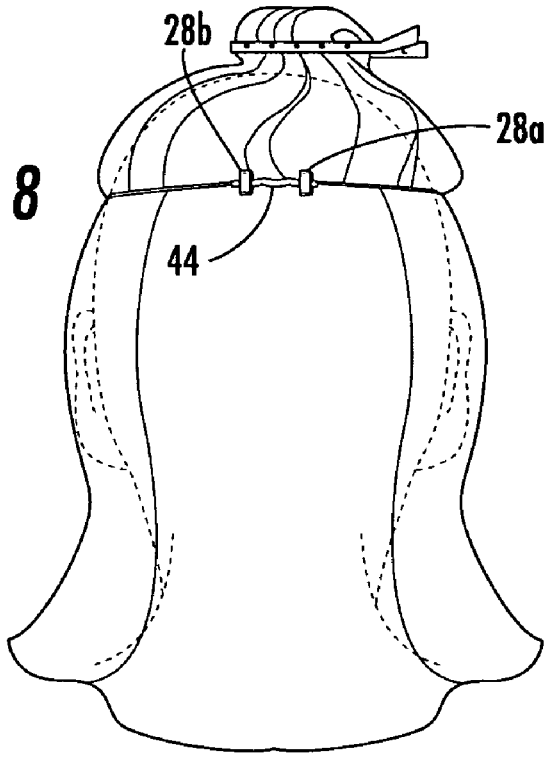
FIG. 8 is substantially a rear view of the person's head as shown in FIG. 7, further showing a track of hair formed in between two bands.
Figure 9:
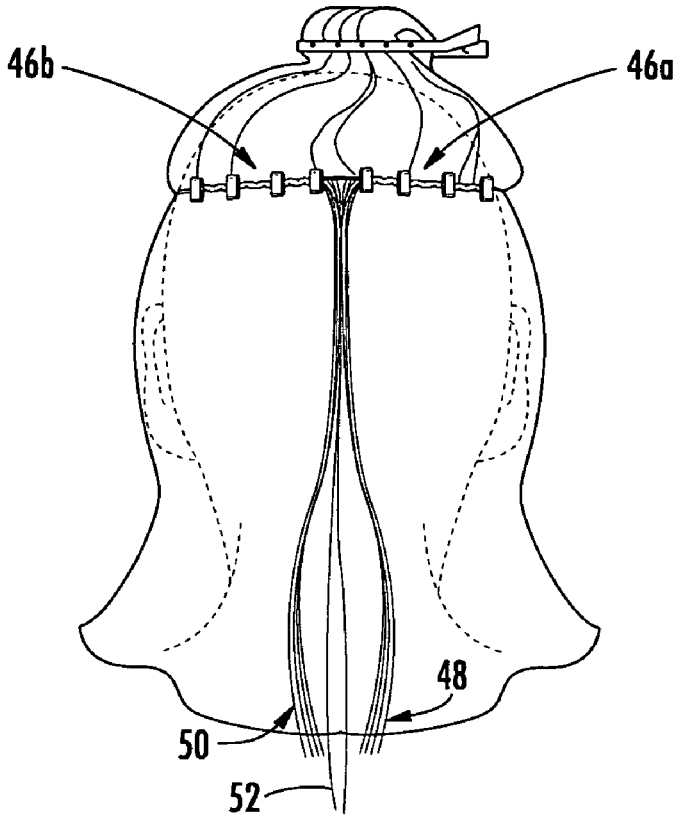
FIG. 9 is substantially a rear view of the person's head as shown in FIG. 8 with additional bands provided to form one elongate track of hair on each side of the person's head and further showing a step of joining the elongate tracks from both sides of the head at the middle.

Referring to FIG. 8, band 28*b* is preferably positioned side by side with and proximate to band 28*a*. In between bands 28*a* and 28*b* is the second portion 44 of Hair Mixture A. In FIG. 9, the steps illustrated in FIGS. 2-8 are preferably repeated several times to preferably create two tracks of original and artificial hair or rope combination 46*a* and 46*b*. One track of original and artificial hair or rope combination 46*a* is preferably positioned on one side of the person's head, and another track of original and artificial hair or rope combination 46*b* is preferably positioned on the opposite side.

Figure 10:
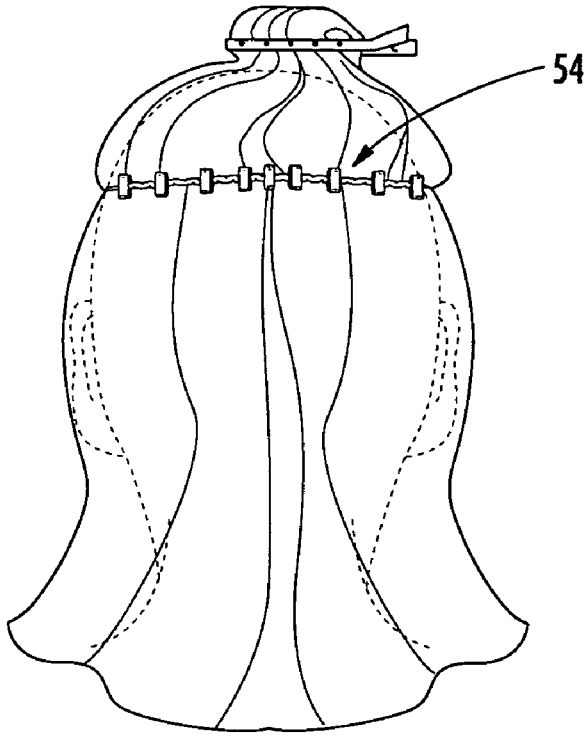
FIG. 10 is substantially a rear view of the person's head as shown in FIG. 9, further showing a plurality of bands forming two sets of hair tracks. One set is preferably provided on each side of the person's head.

With continued reference to FIG. 9, the original and artificial hair or rope combination 48 of track 46*a* is preferably combined with the original and artificial hair or rope combination 50 of track 46*b* and a third group of the person's original hair 52 to create Hair Mixture B. The amount of Hair Mixture B is preferably reduced to arrive to an amount that would fit within the hollow interior of a band. In FIG. 10, the remaining amount of Hair Mixture B is preferably inserted through the hair grouping device 22, just like in FIG. 7. The hair grouping device 22 is preferably moved towards the scalp of the person, and the user preferably slides a band 28 toward the continuously looping end 24 of the flexible material 32 until Hair Mixture B is inserted through the hollow interior of the band 28. Tracks 46*a* and 46*b* are joined, and a continuous track of the combination of original and artificial hair is preferably formed, as shown by reference number 54 in FIG. 10.

Figure 1:
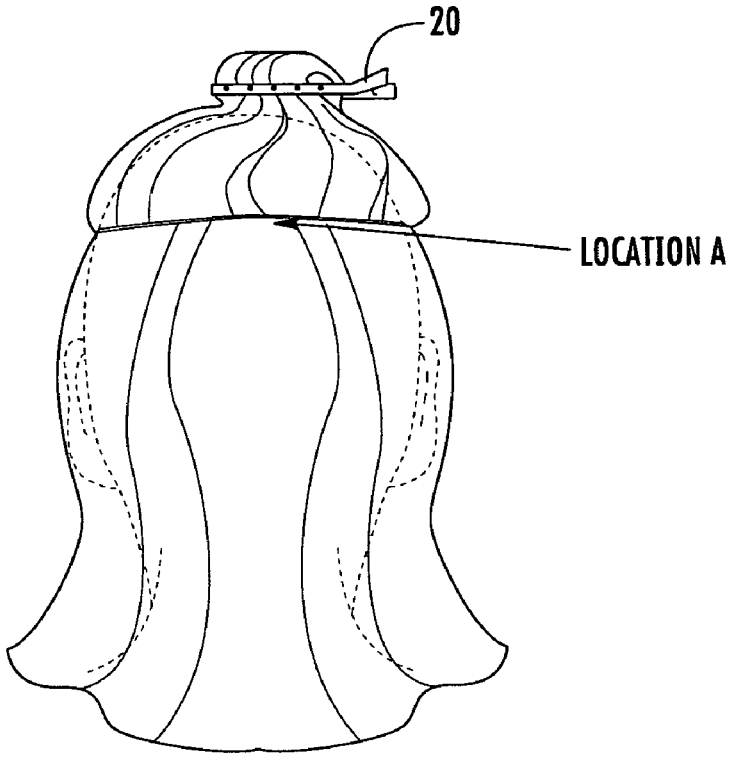
FIG. 1 is substantially a rear view of a person's head showing a manner of determining a location to attach a hair extension and preparing the location for the attachment.
Figure 12:
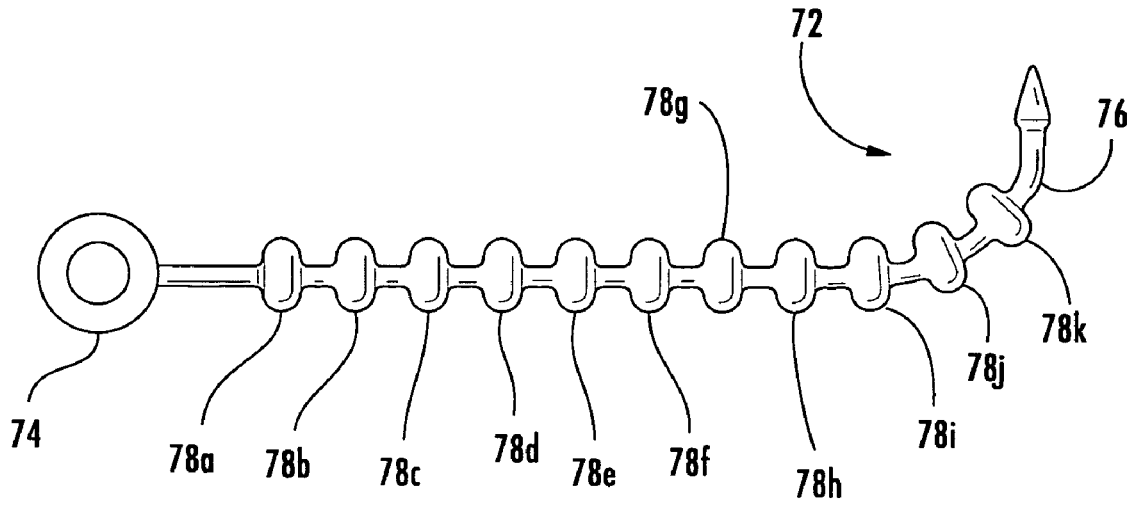
FIG. 12 is substantially a front view of an embodiment of a custom tie of the present invention.

Referring now to FIG. 1, an extension hair 66, such as a hair weft, may be temporarily hanged to the continuous track 54 by using hairpins 62*a* and 62*b*. The extension hair 66 may then be sown to the continuous track 54.by various techniques, such as by using a thread and a needle (not shown). Referring to FIG. 12, a custom tie 72 may be used instead of using threads and needles. The custom tie 72 preferably includes a locking element receiving end 74, a guiding end 76, and a plurality of locking elements 78*a-k* therebetween. The guiding end 76 is preferably bent and sturdy. The locking elements preferably have the shape of a ball although various shapes may be implemented and still fall within the spirit of the invention. The custom tie 72 may be made from plastic, polymers, or other materials known in the art.

Figure 13:
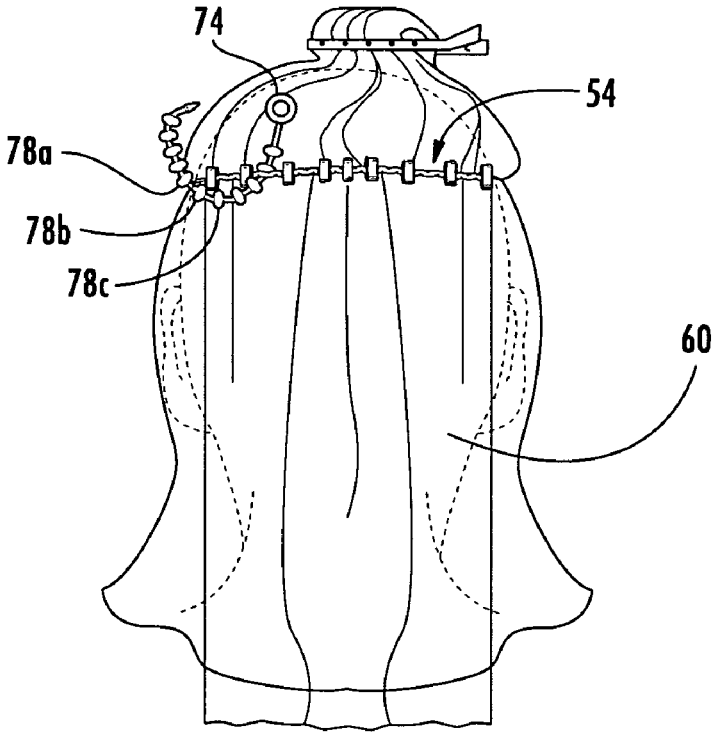
FIG. 13 is substantially a schematic illustration of how the custom tie in FIG. 12 is used to attach a hair weft to one side the hair track.

Referring to FIG. 13, the user may attach the hair weft 60 to the hair track 54 using the custom tie 72. The user may insert the guiding end 76 of the custom tie 72 underneath and through the track 54 and the hair weft 60. The user may then insert the guiding end 76 through the receiving end 74 and pull the guiding end until at least one of the locking elements 78*a-g* goes through and abuts the receiving end 76, and the custom tie 72 tightly holds the track and the hair weft.

It can be realized that the implementation of the custom tie 72 makes the hair extension method easier and faster to complete than by using conventional thread and needle. It can also be realized that the custom tie 72 provides a stronger attachment for the hair weft than conventional threads. This is especially true, as conventional threads may have tendencies to unravel, and conventional threads may break when hair grows and adds pressure to the threads. Hair extensions may last longer with the use of custom ties 72 than with threads, as threads may break or unravel when a comb or a brush pulls them.

Related Devices

Alternative Hair Weft

Figure 11:
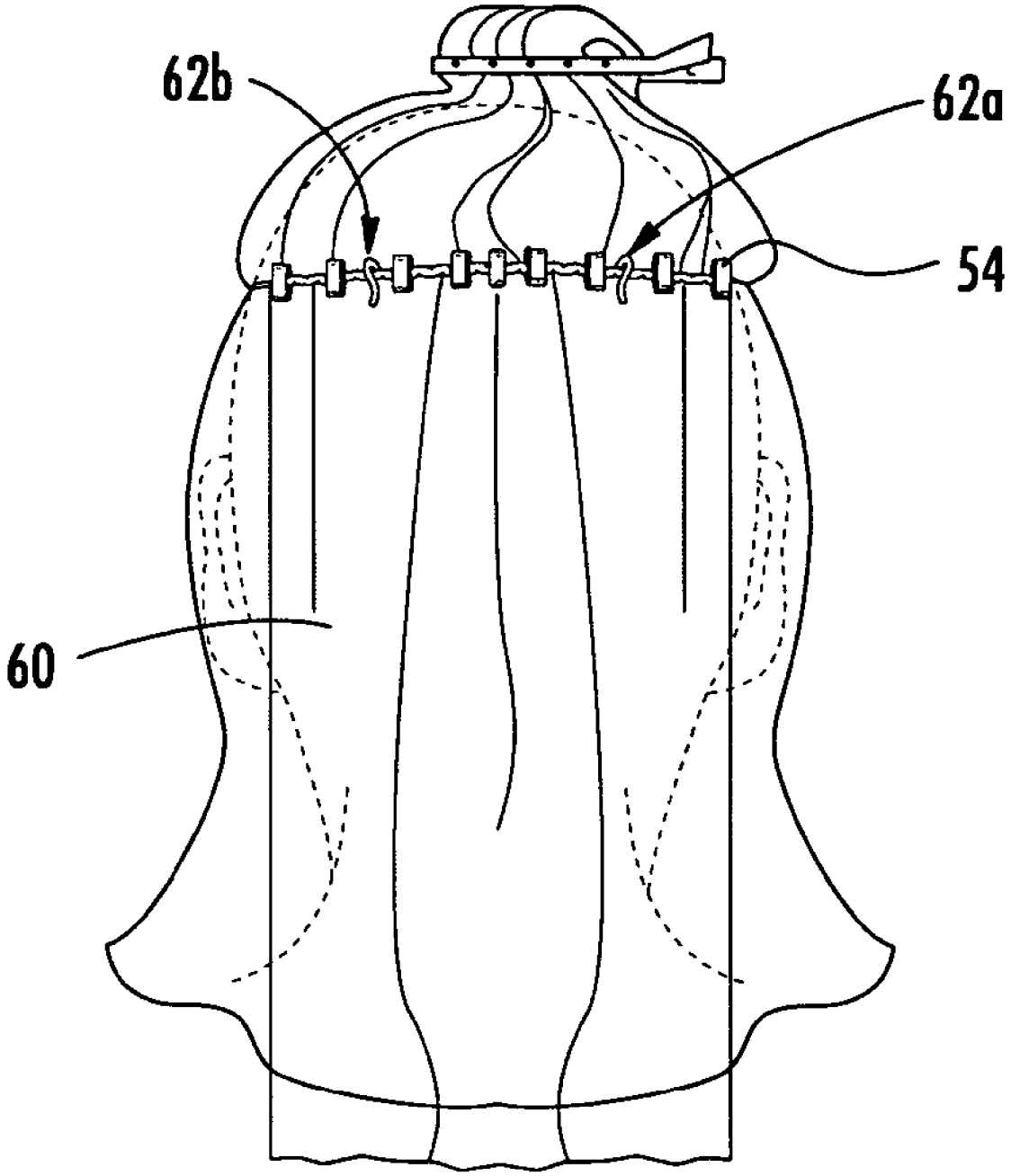
FIG. 11 is substantially a rear view of the person's head as shown in FIG. 10, further showing a step of attaching a hair weft to the hair tracks.
Figure 14:
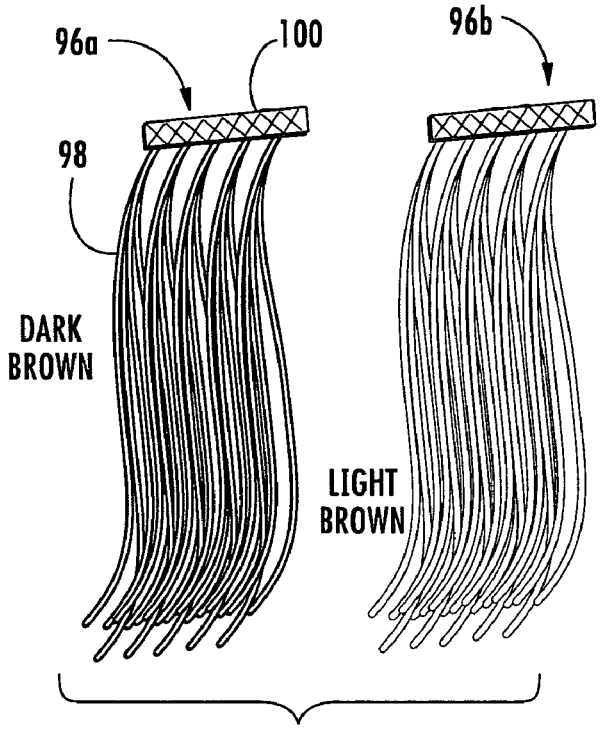
FIG. 14 is substantially a front view of one embodiment of a plurality of shortened hair wefts of the present invention.

In another embodiment of the hair extension method, a plurality of shortened hair wefts are preferably used instead of the unitary hair weft 60 shown in FIGS. 11 and 13. Referring to FIG. 14, the colors of each of the shortened hair wefts may preferably vary. For instance, one hair weft 96*a* preferably has a dark brown color, and another hair weft 96*b* preferably has a light brown color. Each shortened hair weft 96*a* and 96*b* preferably includes a plurality of grouped strands of artificial hair. Each group of artificial hair strands 98 preferably comprises a plurality of artificial hairs. The plurality of grouped artificial hair strands is preferably held together by an adhesive, stitching, or combination thereof, which defines a substantially flat surface 100. Both sides of the surface 100 may include an adhesive to allow the hair weft 96*a* or 96*b* to be positioned on top of each other. The adhesive on the both sides of the surface 100 may be covered by a peelable material known in the art, which can be removed prior to use. It can be appreciated that this feature allows hair wefts of different colors to be easily combined to produce the desired hair extension color.

Alternative Band Material

Figure 15:
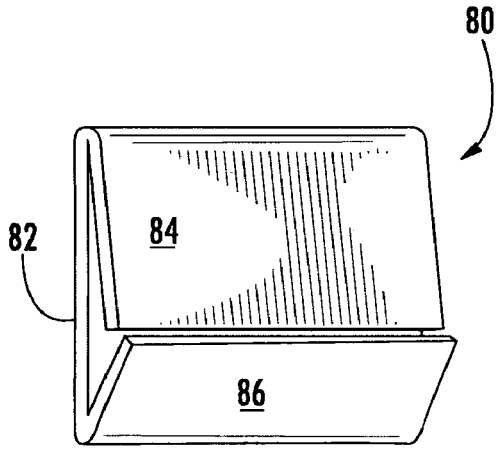
FIG. 15 is substantially a perspective view of an embodiment of a band material of the present invention.

Referring now to FIG. 15, an alternative band material 80 is shown. Alternative band material 80 is preferably a one-piece flexible material, such as titanium, aluminum, or copper. Alternative band material 80 preferably includes a substantially flat back surface 82. A top front surface 84 and a bottom front surface 86 preferably extend from the flat back surface 82. The top front surface 84 and the bottom front surface 86 are preferably separated so that they may moved so as to allow placement of the original hairs, the artificial hairs, or the rope in the interior of the alternative band material 80.

In using the alternative band material 80, the user may not need to use the hair grouping device 22. The user may simply collect a first group of original hair, a group of artificial hair or a rope, separate the front surfaces 84 and 86 of the alternative band material 80 and insert the collected materials in the alternative band material 80. The front top and bottom surfaces 84 and 86 may be crimped towards the back surface 82 to tighten the hold on the inserted materials. The user may repeat the same steps with a second group of original hair and so on, similar to the steps described in FIGS. 6, 7, and 8 above but with the use of the alternative band material 80 and without the use of the hair grouping device 22, to form the continuous hair track 54.

It can be appreciated that with the alternative band material 80, the hair extension is more discreet than with the cylindrical bands 28*a, b,* and *c*, as the back surface 82 of the alternative band material 80 may lay flush on the person's head. It can be appreciated also that the implementation of the alternative band material 80 in the hair extension method simplifies the hair extension method, particularly in creating the hair track.

Alternative Crimping Device and Band Opener

Figure 16:
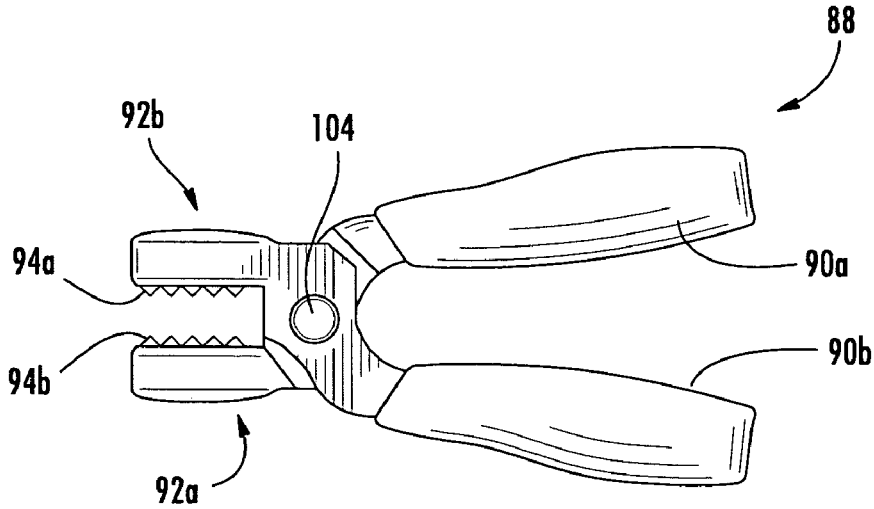
FIG. 16 is substantially a plan view of an embodiment of band crimper of the present invention.

With reference to FIG. 16, a crimper 88 may be used to crimp bands 28*a, b*, and *c* or the alternative band material 80 to tighten the bands' hold on the inserted materials. The crimper 88 preferably includes a pair of handles 90*a* and 90*b*. The pair of handles 90*a* and 90*b* preferably extends to their corresponding noses 92*a* and 92*b*. A plurality of teeth 94*a* and 94*b* are preferably attached on the side of the nose that is configured to come in contact with the alternative band material 80 to effectively grip the alternative band material. The pair of handles preferably meets at a pivot point 104, which allows the noses 90*a* and 90*b* to open and close to accommodate and compress the bands 28*a, b*, and *c*, or alternative band material 80.

Figure 17:
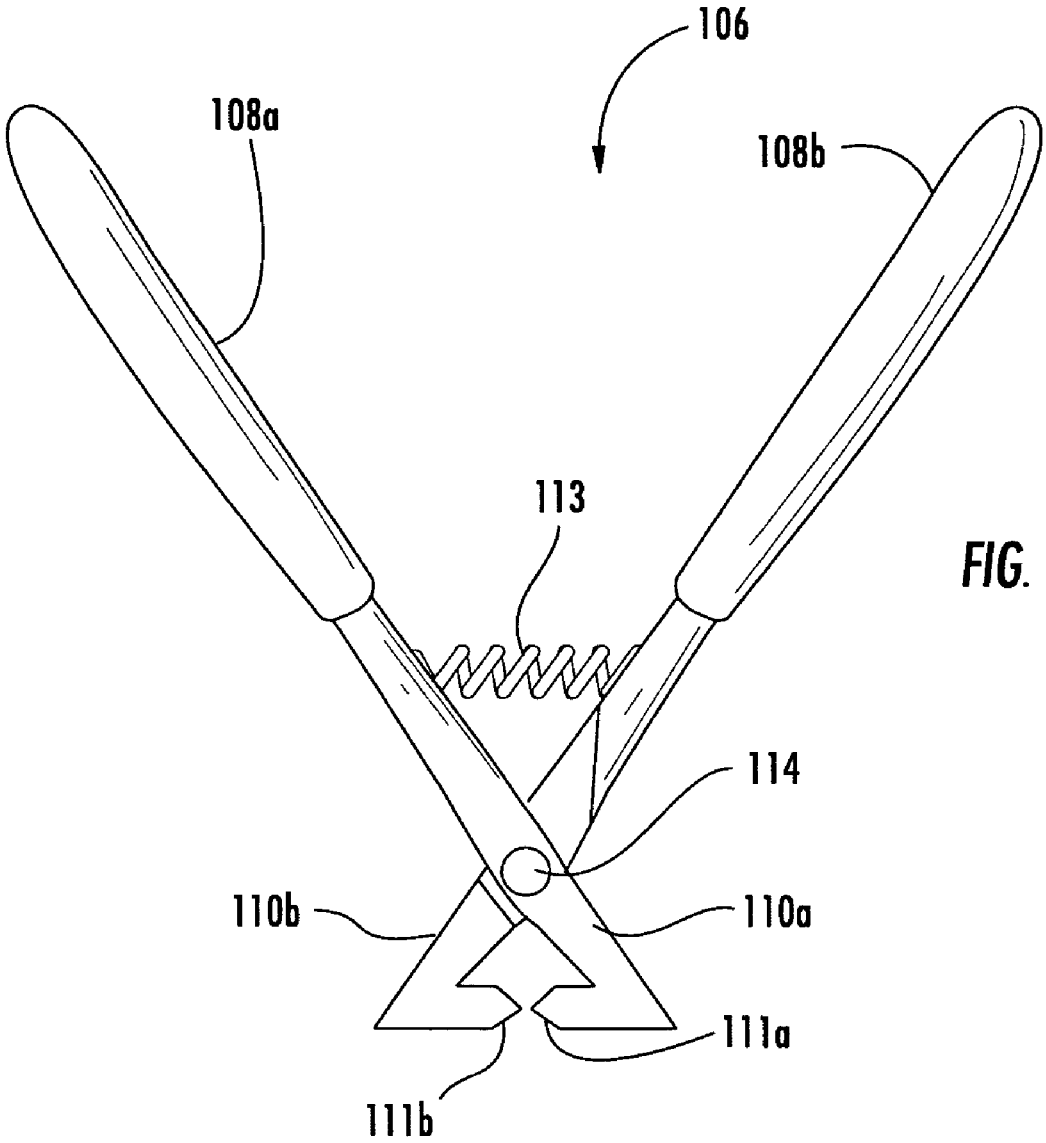
FIG. 17 is substantially a plan view of an embodiment of a band opener of the present invention.

Referring now to FIG. 17, a pair of opener 106 may be used to open the bands 28*a, b*, and *c* or the alternative band material 80 when they have to be removed from the person's head. The opener preferably includes a pair of handles 108*a* and 108*b*. The pair of handles 108*a* and 108*b* preferably extends to their corresponding noses 110*a* and 110*b*. Each nose 110*a* or 110*b* preferably includes a nose extension 111*a* and 111*b*, which is at an angle to the corresponding nose and substantially parallel to a floor (not shown). The end of each nose extension 111*a* and 111*b* that is proximate to the nose is preferably narrower than its opposite end. The nose extensions 111*a* and 111*b* are preferably spaced apart.

The nose extensions 111*a* and 111*b* are preferably configured to enter from the sides of the band material. Pressure may be applied to the pair of handles thereby opening the band material. The opener 106 preferably includes a biasing device 113, such as a spring to promote the closing and opening action of the opener 106.

Hair Extension Kits

Figure 18:
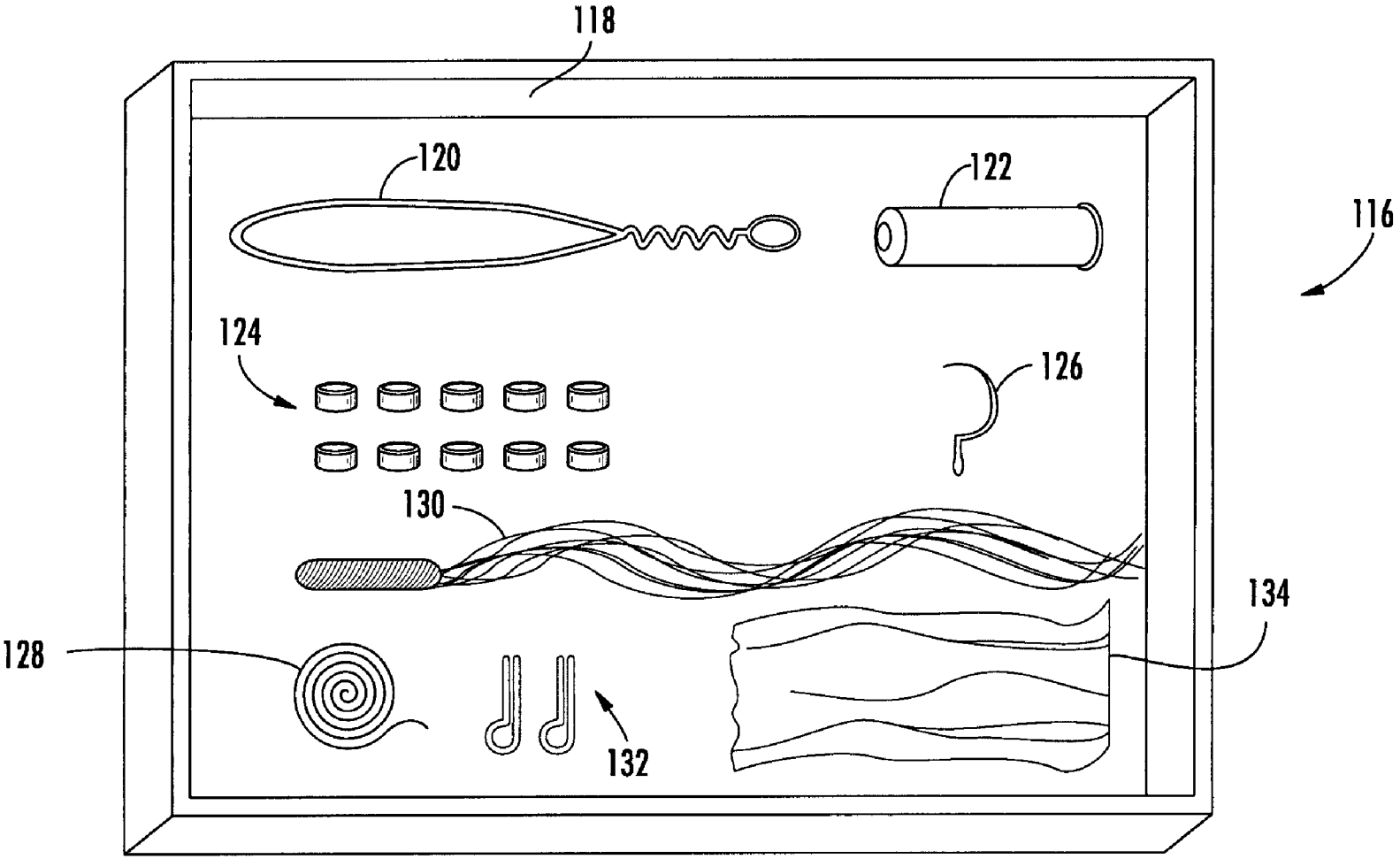
FIG. 18 is substantially front elevational view of one embodiment of the hair extension kit of the present invention.

Referring to FIG. 18, a hair extension kit 116 may be used to implement at least one embodiment of the hair extension methods of the present invention. Hair extension kit 116 may include a housing 118, a piece of flexible material 120, such as a piece of wire, a flexible material holder 122, a plurality of bands 124, a needle 126, a loop of thread 128, at least one group of artificial hairs 130, a pair of hair pins 132, and a hair weft 134. The flexible material holder 122 may be punctured using the piece of flexible material 120 to attach the flexible material 120. It is noted that some of the materials above may be eliminated or substituted and still fall within the scope of invention. For instance, the group of artificial hairs 130 and the hair weft 134 may be eliminated, and a distributor may choose to sell them separate from the hair extension kit 116. Other materials may be added to the kit 80, such as a pair of band crimpers (not shown).

Figure 19:
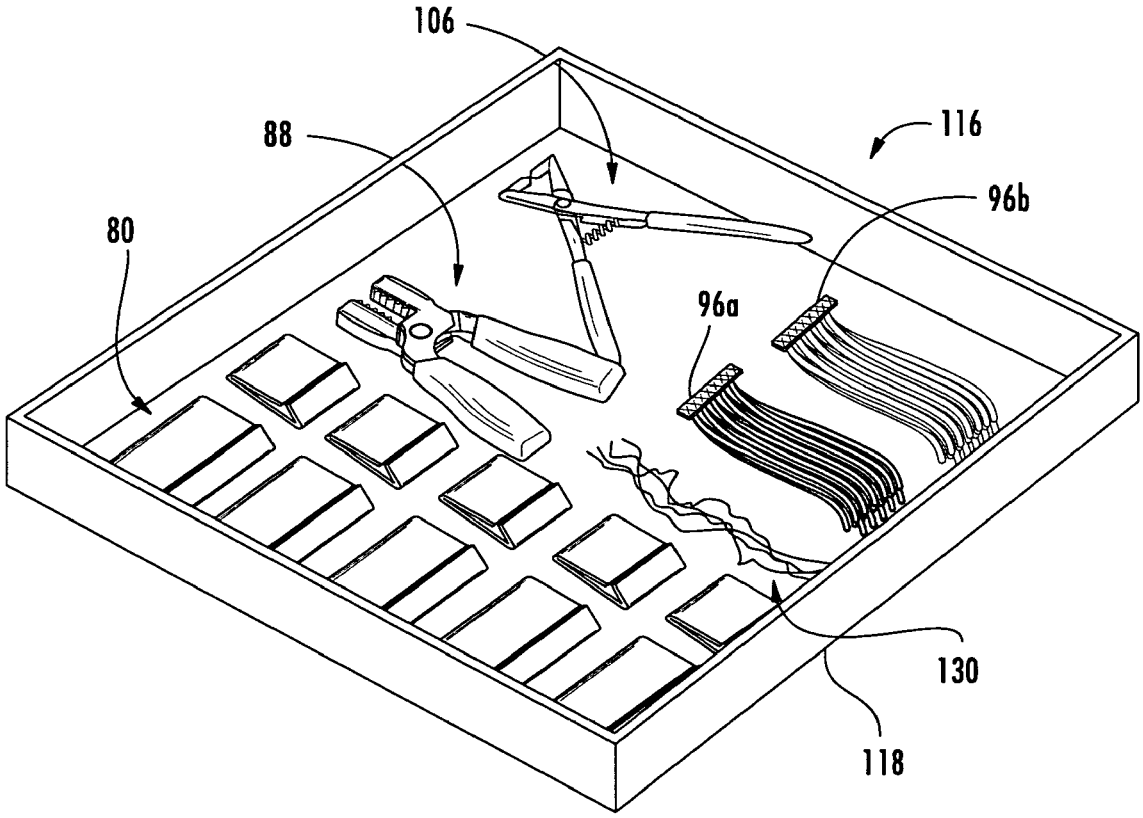
FIG. 19 is substantially front elevational view of another embodiment of the hair extension kit of the present invention.

Referring to FIG. 19, another extension kit 116 may be provided to implement another embodiment of the hair extension methods of the present invention. Hair extension kit 116 may include a housing 118, a plurality of alternative band materials 80 of various sizes, a crimper 88, an opener 106, a plurality of shortened hair wefts 96*a* and 96*b*, and a rope 120. Of course, some materials may be eliminated, added, or substituted and still fall within the scope of invention.

It can now be appreciated that with certain embodiments of the hair extension methods of the present invention, the hair extension is attached in a manner that alleviates the original hair from stress, as artificial hairs or rope and the person's original hairs support the hair extension. Alleviating the original hair from stress is especially beneficial for providing hair extensions to persons with fine or thin hair to allow their hair extensions to last for a long time. Alleviating the original hair from stress also minimizes the feeling of the original hair being pulled, and thus, makes hair extensions more comfortable to wear.

Certain embodiments of the present invention also provide a hair extension technique that minimizes the creation of bumps, gaps, and crevices within the lengths of the hairs and prevents hair brushes or combs from being trapped thereby facilitating smooth hair brushing. Certain embodiments of the present invention also provide a durable and secure attachment of the hair extension. Certain embodiments further provide a hair extension method that can be implemented with minimal time and devices that can help accomplish the same. Finally, certain embodiments provide a hair extension method suitable for creating hair extensions with mixed hair colors.

Although the description above contains many specifications, these should not be construed as limiting the scope of the invention but as merely providing illustrations of some of presently preferred embodiments of this invention. For instance, the materials used to create the band and the hair grouping device may vary. Thus, the scope of the invention should be determined by the appended claims and their legal equivalents rather than by the examples given.

What is claimed is:

1. A method of extending hair, the method comprising:

a. determining a location around a scalp for attaching at least one extension hair;

b. gathering a first group of original hair, the first group of original hair being proximate to the portion of the scalp determined to be the location for attaching the extension hair;

c. inserting a portion of the first group of original hair in a first band;

d. providing a first group of artificial support material;

e. inserting a portion of the first group of the artificial support material in the first band, the combination of the first group of original hair and the first group of artificial support material forming a first hair combination;

f. gathering a second group of original hair, the second group of original hair being substantially proximate to the first hair combination;

g. inserting in a second band the combination of at least one hair from the second group of original hair and a portion of the first hair combination, the hairs in between the first and the second band defining a hair track;

h. attaching the extension hair to the hair track;

i. repeating steps 1(*a*)-1(*h*) to form a hair track and attaching the extension hair to the hair track, wherein the extension hair comprises a hair weft;

j. providing a tie having an elongate body, a locking element receiving end attached on one end of the elongate body, at least one locking element attached to the elongate body, and a guide end attached on the end of the elongate body opposite the receiving end;

k. allowing the guide end of the tie to pass through a portion of the hair track on at least one side of the scalp;

l. allowing the guide end of the tie to pass through a portion of the hair weft;

m. inserting the guide end through the locking element receiving end; and n. allowing the locking element to go through the locking element receiving end thereby allowing the elongate body in between the locking element receiving end and the locking element to define a boundary that confines the portion of the hair track and the portion of the hair weft.

2. The method of claim 1, wherein the hair track is formed on one side of the scalp and further comprising:

a. repeating steps 1(i)-1(h) to form a hair track on the opposite side of the scalp; and b. attaching the extension hair to the hair tracks on both sides of the scalp.

3. The method of claim 1, further comprising using a hair grouping device to insert at least one of the groups of hairs into at least one of the bands, the hair grouping device comprising a flexible material looped around to form a continuously looping end, the hair grouping device having a first end opposite the continuously looping end and configured to receive at least one band, the band being insertable through the first end and slidable towards the looping end.

4. The method of claim 3, wherein the hair grouping device is made of a wire.

5. The method of claim 1, wherein the artificial support material comprises a group of artificial hair.

6. The method of claim 1, wherein the artificial support material comprises a rope.

7. The method of claim 1, wherein at least one of the bands comprises a flexible cylindrical material, the flexible cylindrical material comprising a substantially circular wall that defines an opening, the opening allows the original hairs and the artificial support material to be inserted therein, the flexible cylindrical material being compressible so as to grip the materials inserted therein.

8. The method of claim 1, wherein at least one of the bands comprises a compressible material having a substantially flat back, a substantially flat front top surface extending from the back, and a substantially flat front bottom surface extending from the back, the front top and the front bottom surfaces being separated, wherein the separation of the front top and the front bottom surfaces provide an opening for the insertion of the original hairs and the artificial support material, and wherein the substantially flat back of the band may lay substantially flush on a person's head.

9. The method of claim 1, further comprising providing a plurality of hair wefts, each hair weft comprising a plurality of hair groups, one end of the plurality of hair groups being arranged in side by side and grouped together to form a grouped hair end, the grouped hair end comprising two opposing sides, each side comprising an adhesive.

10. The method of claim 9, further comprising:

a. attaching at least a portion of the first hair weft to the hair track; and b. attaching at least a portion of the second hair weft onto the first hair weft.

11. The method of claim 10, wherein the first hair weft comprises a first hair color and the second hair weft comprises a second hair color.

* * * * *